United States Patent [19]

Amann et al.

[11] 4,398,361

[45] Aug. 16, 1983

[54] RECOVERY OF SEDIMENTS FROM THE BOTTOM OF THE SEA BY SUSPENDED SUCTION PIPE

[75] Inventors: Hans Amann; Jurgen Burkhardt, both of Hanover, Fed. Rep. of Germany

[73] Assignee: Preussag Aktiengesellschaft, Fed. Rep. of Germany

[21] Appl. No.: 197,792

[22] Filed: Oct. 17, 1980

[30] Foreign Application Priority Data

Oct. 19, 1979 [DE] Fed. Rep. of Germany ..... 2942303

[51] Int. Cl.[3] ..... E02F 3/92

[52] U.S. Cl. ..... 37/57; 37/58; 37/195; 175/5

[58] Field of Search ..... 37/195, 54, 58, 57, 37/63, 71; 175/394, 58, 5, 6; 299/8, 9; 73/864.43, 864.41

[56] References Cited

U.S. PATENT DOCUMENTS

| | | | |
|---|---|---|---|
| 491,843 | 2/1893 | Kauser | 37/61 |
| 2,414,797 | 1/1947 | Brown | 37/58 |
| 3,226,854 | 1/1966 | Mero | 37/58 |
| 3,620,572 | 11/1971 | Krutein | 37/56 X |
| 3,748,760 | 7/1973 | Schnell | 37/58 |
| 3,949,496 | 4/1976 | De Koning et al. | 37/72 X |
| 4,200,999 | 5/1980 | Latimer | 37/72 X |

FOREIGN PATENT DOCUMENTS

| | | | |
|---|---|---|---|
| 2707899 | 8/1978 | Fed. Rep. of Germany | 37/58 |
| 2034787 | 6/1980 | United Kingdom | 37/58 |

*Primary Examiner*—Clifford D. Crowder

*Attorney, Agent, or Firm*—Allegretti, Newitt, Witcoff & McAndrews, Ltd.

[57] ABSTRACT

In a method and apparatus for the recovery of sediments from the sea bottom, a suction head is lowered into the sediment and continuously moved in the sediment. The suction head includes loosening means in the form of a pivot plate with blades which pivot relative to the suction head in response to continuous movement of the suction head to scrape the sediment to loosen it.

12 Claims, 4 Drawing Figures

FIG. 2
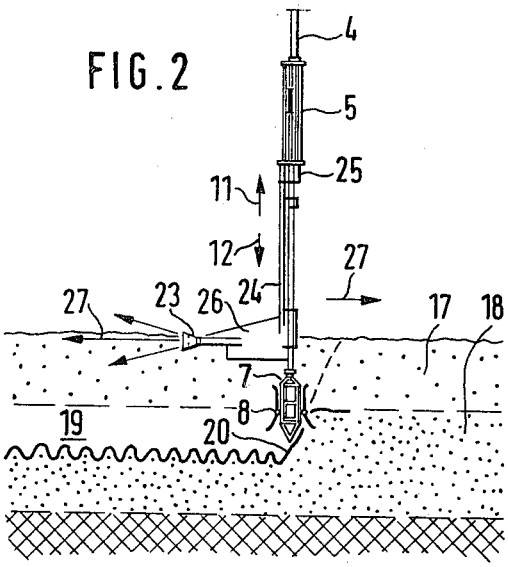
FIG. 4
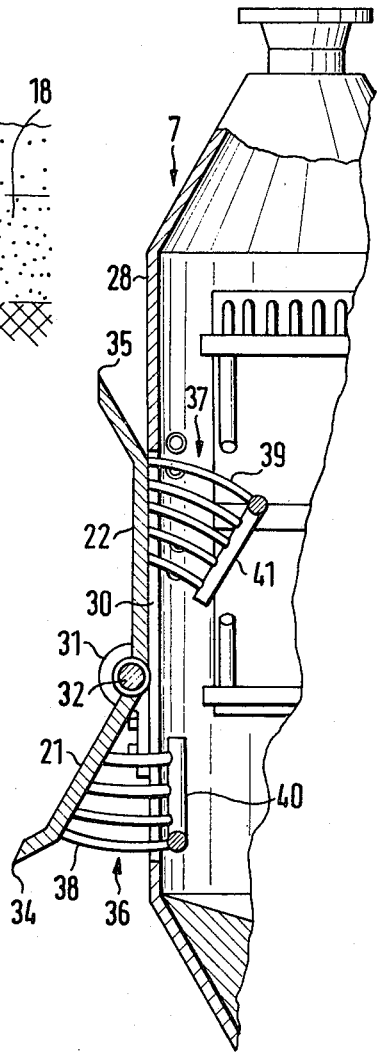
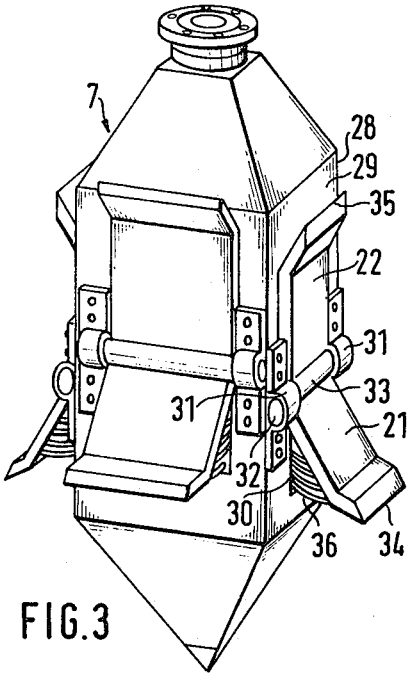
FIG. 3

RECOVERY OF SEDIMENTS FROM THE BOTTOM OF THE SEA BY SUSPENDED SUCTION PIPE

BACKGROUND AND SUMMARY OF THE INVENTION

The invention relates to a method for the recovery of sediments from the bottom of the sea by means of a freely suspended suction pipe provided at one end with a suction head which is slowly lowered into the sediment, while loosening means attached to the suction head are being kept in motion to dislodge the sediment.

The invention further relates to a device for carrying out the method, comprising a floating body from which the suction pipe is suspended which carries at its lower end the suction head having attached thereto the loosening means to dislodge the sediment to be recovered.

A prior art conveyor apparatus is known from German patent specification DE-OS No. 2 707 899, which includes a conveyor pipe, the lower end of which is movable and tightly fitting along its circumference into a cylindrical structure. Disposed between the cylinder and the end of the conveyor pipe is a drive means to reciprocate the two components in an opposed motion. This reciprocating motion not only serves to produce a pumping action, but also produces high frequency vibrations. Such vibrations are intended to assist in the penetration of the mud to be conveyed and to prevent the creation of channels therein. This object, however, is achieved only partially in actual practice.

The same disadvantage has been found in the conveyor device according to the earlier German patent specification P 28 41 203.5 in which vibrations are produced in a similar fashion as in the afore-mentioned well known device to loosen bottom formations. The vibratory movements are performed by a vibratory screen which may be in the shape of a cone pointing downward so that the direction of vibration is vertical. A device of this type is not capable of successfully loosening and dislodging relatively compact formations of a mud-like consistency from the sea bottom as they occur, for example, in the Red Sea at great depths. In any event, a device of this type is not capable of adequately loosening and dislodging sediment at any great depths in the sediment layers, but only near the less compacted surface where the sediment is of a sufficient fluidity.

It is the object of the present invention to provide a method for the recovery of sediments by means of a freely suspended suction pipe by which sediments having the consistency of compacted mud can be recovered easily and effectively from sediment layers of considerable depths.

This object is achieved by the method of the invention according to which the motion of loosening means is generated by the motion of the suction pipe. This has the great advantage that the free hanging suction pipe itself is directly utilized for the transfer of energy required to operate the loosening means so that no additional outside energy in the form of hydraulic powered lines or electrical cables is necessary. Moreover, no complicated drive motors need be provided on the suction head.

The principal premise of the present invention can be practiced in at least two different ways: first, by rotating the suction pipe on its upper end and, second, by continuously moving the suction pipe up and down. These two degrees of motion may also be scheduled to overlap. The heavy weight of the freely suspended suction pipe prevents great speeds, but the forces available to be transmitted to the lower end of the suction pipe are considerable. When lowering the suction pipe, the weight of it combined with the weight of the elements attached thereto, such as the suction head or the like, may be utilized to operate loosening tools as, for instance, scrapers or the like, which can scrape along the surface of a steep bank to loosen the material to be recovered. In similar fashion, great forces may be taken advantage of as the suction pipe is raised.

In order to generate a lateral reaction force by the loosening means upon a bank, the upper end of the suction pipe is constantly advanced toward one side so that the entire pipe assembly hangs tilted as at an oblique angle, and its weight, or the weight of the suction head, generates the force by which the loosening means are thrust against the bank to cut into the sediment along the edge of the bank.

Where rotary motion is employed to operate the suction pipe, the situation is similar. However, the rotary motion also produces forces in the direction of the continuous movement of the suction pipe which are transverse to the desired feed direction so that, in addition, a lateral sag is produced.

A device for carrying out the method of the invention includes a flexible suspension means on a floating body which may include a pivot bearing, with a rotary drive means being provided for rotating the suction pipe. Another embodiment of flexible suspension includes a vertically operating hydraulic device having a gas pressure storage container for compensating the weight of the suction pipe so that a drive means merely needs to generate the power to operate the loosening tools.

In the embodiment of the invention employing a vertical up and down movement, the preferred loosening means consists of blades, scrapers, or the like, because the required forces are within reasonable limits and the material fragments stripped from the sediment are of a rather uniform size and shape which is conducive to an efficient suction and conveying operation.

The stripping or scaling edges may be provided on hinged pivot plates which open up only in one direction of movement to effect the stripping, while folding down in the other direction of movement, thereby constituting a low degree of frictional resistance. However, depending on the character of the sediment, it may be of advantage to employ twin pivot plates which are operative in both directions of movement. In addition, the pivot plates may be provided with screens which project from the pivot plates into the interior of the suction head, that is, they follow the movement of the pivot plates. This has the result that rocky or lumpy material accumulating on the outside of the screen falls off.

As previously mentioned, the reaction forces may be generated by inducing a lateral sag of the suction pipe. It has also been found to be advantageous to provide a nozzle at the suction pipe above and/or on the suction head itself. The nozzle is connected with a water pressure source and is directed transversely to the direction of the suction pipe and facing away from it so as that the desired reaction forces are produced by recoil action. The direction of the forward thrust may be determined by an appropriate rotational movement of the pipe. This, however, may be difficult with large lengths of the free hanging suction pipe. For this reason it is preferred to provide mechanical guide means in the form of guide plates by which the suction head is guided in the trench.

BRIEF DESCRIPTION OF THE DRAWINGS

The invention will be described in further detail with reference to the accompanying drawings, in which:

FIG. 2 is a view similar to the lower portion of FIG. 1, showing an additional guide plate and a nozzle;

FIG. 3 is a perspective view of the suction head shown in FIGS. 1 and 2 in an enlarged scale;

FIG. 4 is a broken view of approximately half of the suction head of FIG. 3 in section.

DESCRIPTION OF THE PREFERRED EMBODIMENTS

Figure 1:
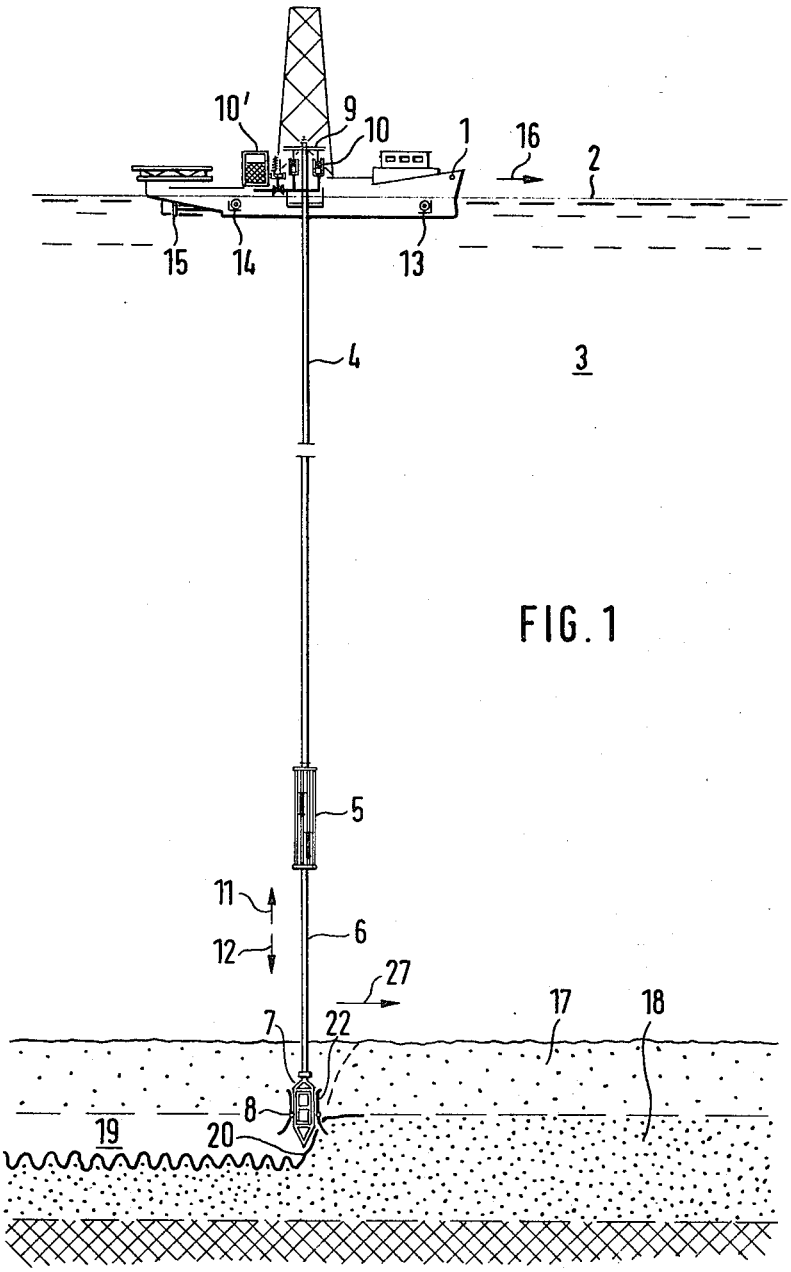
FIG. 1 is a schematic representation of the principles underlying the method of the invention and apparatus for carrying out the method.

In a schematic illustration of FIG. 1, a ship 1 is positioned on the surface 2 of a body of sea water 3. Extending downwardly from the ship 1 is a conveyor pipe 4, the lower section of which has mounted thereon a pump 5 from which a suction pipe 6 leads to a suction head 7 which is provided with a pair of pivot plates 8.

The conveyor pipe 4 is suspended on the ship 1 by a suspension structure 9. The suspension structure 9 is supported on two hydraulic cylinders 10 by means of which the conveyor pipe 4 and the members attached thereto, in particular the suction head 7, are movable upwardly and downwardly in the direction of the arrows 11 and 12. The hydraulic cylinders 10 are biased by a gas pressure storage container 10'.

Provided in the bow of the ship 1 is a drive means 13 which, together with the drive means 14 in the ship's stern, serves to maintain the ship in directional alignment about the vertical axis. Further provided in the rear of the ship is a screw propeller 15 by which the ship is slowly and steadily advanced in the direction of the arrow 16.

In the position illustrated in FIG. 1, the suction head 7 is operatively located in the region of a sediment consisting of two layers 17 and 18. The layer 17 has a viscosity such as to permit the suction head 7 to be freely laterally movable in the layer 17. This layer is presumed to be also fluid to a certain degree to be able to flow into a trench 19 formed in the layer 18 by the suction head 7 so that it is not even necessary to raise the suction head 7 up to the level of the layer 17 during the recovery operation.

The suction head 7 works toward the right as viewed in the drawing. In this operation there is employed substantially only the right hand pivot plate of the dual plate unit so that its lower half 21 scales a flat layer off the bank 20. This layer is entrained by the fluid flow due to the suction action and is conveyed by the suction pipe 6 to the pump 5 and from there by the conveyor pipe 4 to the ship 1.

The illustration in FIG. 1 is not to scale. In reality, the trench 19 is considerably deeper so that the scaling or stripping action performed by the half plate 21 of the dual plate unit 8 is effective over a relatively long stretch of the bank 20. It will be clearly seen that at a corresponding upward movement the half plate 21 will pivot inwardly, and the other half of the dual plate unit 8, the half plate 22, will pivot outwardly to again ready itself for a stripping cycle.

If the stripping or scaling edges are sufficiently sharp, only minimal reaction forces are required to ensure an effective stripping action. Such reaction forces are generated when the ship 1 is slowly moved in the direction of the arrow 16 in accordance with the general speed of the recovery work, care being taken that the ship is always slightly ahead of the suction head, thereby causing an inclination of the suction pipe 6 7. This will result in a lateral sag of the conveyor assembly by which the desired reaction forces are generated due to the aforementioned inclination of suction pipe 6 taken in combination with gravity.

Another mode of producing the reaction forces is illustrated by the embodiment shown in FIG. 2. This figure is similar to the lower part of FIG. 1, with like parts having like reference numerals. However, the suction pipe 6 is additionally provided with a nozzle 23 which is in communication by a pressure conduit 24 with a compression pump 25 disposed below the conveyor pump 5. The nozzle 23 releases a stream of water at a high velocity in the direction of the arrows 27 so that a forward thrust is exerted in the direction of the arrow 27 which produces corresponding reaction forces for the suction head 7 on the bank 20.

In addition, the embodiment of FIG. 2 is provided with a guide plate 26 to enable a maximum straight line advance in the trench 19.

In both the embodiments of FIGS. 1 and 2, the upward movement in the direction of the arrow 11 is only of an extent so as to prevent the suction head 7 from rising out of the trench 19. The suction head 7 remains in the trench 19 at all times and, thus, in engagement with the bank surface 20. This prevents the suction head 7 from moving into the layer 17 due to the lateral forward thrust in the direction of the arrow 27 caused by lateral sag or by recoil action. If the suction head 7 moved into layer 17, the recovery operation on the bank 20 would no longer occur in the desired manner.

The suction head employed in the embodiments of FIGS. 1 and 2 is shown in an enlarged scale and perspective view in FIG. 3, and FIG. 4 is a sectional view of about half of it in a still further enlarged scale. In the following description, reference will be made simultaneously to both FIG. 3 and FIG. 4.

The suction head 7 comprises a box-like housing 28 of a substantially square cross section. The outer surface areas 29 of the housing 28 are provided with rectangular openings or cutouts 30 on the sides at which are positioned bearing blocks 31 for rotatably supporting a shaft 32 to which is mounted a dual plate unit 33. The two half plates 21 and 22 of the dual plate unit 33 are provided with blades 34 and 35, respectively.

The two half plates 21 and 22 of the dual plate unit 33 are provided with screens 36 and 37 which consist essentially of circular rods 38 and 39 attached on the inner side to bars 40 and 41 for greater stability. Thus, the screens 36 and 37 serve to cover the openings when the half plates 21 or 22, respectively, are pivotally moved out of the openings so that larger rocks or lumps of material are prevented from entering. In the illustration in FIG. 4, the lower half plate 21 of the dual plate unit 33 happens to be open and the screen 36 is in action. If when in this position, rocks or lumps gather in front of the rods 38 forming the screen, they fall off when the half plate 21 moves back inwardly and the suction action in this location ceases.

The suction head shown in FIGS. 3 and 4 is provided on each side of the square housing 28 with dual plate units, for the purpose of effecting a stripping action also along the side walls of the trench 19. In order for the screens 36 and 39 not to mutually interfere with each other in this arrangement of four dual plate units, the screens 36 and 39 and dual plate units are vertically offset on adjacent sides.

It will be understood that the embodiments of the present invention which have been described are merely illustrative of a few applications of the principles of the invention. Numerous modifications may be made by those skilled in the art without departing from the true spirit and scope of the invention.

What is claimed is:

1. A method for the recovery of sediments from the sea bottom by means of a suspended suction pipe having an upper end and provided at its lower end with a suction head adapted to be slowly lowered into the sediment, said suction head comprising a housing, said housing having openings therein, said suction head having mounted thereon lateral loosening means pivotably movable with respect to said housing at said openings for scraping and disintegrating the sediment, comprising activating the loosening means to scrape and disintegrate the sediment vertically by moving the suction pipe continuously vertically up and down and progressively advancing the suction head laterally forward.

2. A method according to claim 1, wherein the activating of the loosening means is effected by continuously moving the upper end of the suction pipe up and down.

3. A method according to claim 1, wherein the continuous vertical up and down movement of the suction pipe is limited so that the suction head always remains below the upper edge of the sediment being recovered thereby preventing said suction head from rising out of the trench formed by the suction head.

4. A method according to claim 1, wherein the advancing of the suction head is effected by advancing the upper end of the suction pipe progressively laterally.

5. An apparatus for the recovery of sediment from the sea bottom by a floating body comprising a suction pipe suspended from said floating body, the lower end of the suction pipe having attached thereto a suction head, said suction head comprising a housing having openings and having mounted thereon a lateral loosening means pivotably movable with respect to said housing at said openings for scraping the sediment, suspension means suspending the upper end of the suction pipe from the floating body, and means for maintaining the suction pipe in continuous reciprocating vertical motion.

6. The apparatus of claim 5, wherein said suspension means is attached to vertically operating hydraulic means having a gas pressure storage container for compensating the weight of the suction pipe and the suction head.

7. The apparatus of claim 5, wherein said loosening means comprises a scraper which extends transversely to said vertical direction of movement.

8. The apparatus of claim 7, wherein said scraper comprises blades secured on hinged pivot plates which are adapted to be pivotably movable into operative position by the movement of the suction head, stops for limiting the movement of said blades in an outward position, said pivot plates also being adapted to be pivotably moved in an inward direction into a rest position upon movement of said suction head.

9. The apparatus of claim 8, wherein said pivot plates comprise dual plates formed of two half plates positioned at an angle with respect to one another, and a bearing located at the vertex of the angle pivotally mounting each of said pivot plates for movement toward and outwardly away from said suction head.

10. The apparatus of claim 9, wherein said dual plates are provided on the sides facing the suction head with screens which are adapted to cover entry openings to the suction head when one of the half plates has been pivotally moved outwardly from the suction head.

11. The apparatus of claim 5, wherein said suspension means has at least one nozzle extending from said suspension means adjacent the suction head and transversely facing away from said suction pipe, said nozzle producing reaction forces for the suction head to press the suction head laterally against the sediment, and having a water pressure source connected thereto.

12. The apparatus of claim 5, including vertical guide plates positioned adjacent the suction head for preventing the suction head from rotational movements.

* * * * *